US010286686B2

(12) United States Patent
Takeda et al.

(10) Patent No.: US 10,286,686 B2
(45) Date of Patent: May 14, 2019

(54) COLOR DEVELOPING MACHINE AND PRINTING DEVICE

(71) Applicant: MIMAKI ENGINEERING CO., LTD., Nagano (JP)

(72) Inventors: Takamichi Takeda, Nagano (JP); Tomohiro Takano, Nagano (JP); Shunsuke Akuta, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/697,458

(22) Filed: Sep. 7, 2017

(65) Prior Publication Data

US 2018/0065382 A1 Mar. 8, 2018

(30) Foreign Application Priority Data

Sep. 7, 2016 (JP) ..... 2016-174971

(51) Int. Cl.

| | |
|---|---|
| ***B41J 2/01*** | (2006.01) |
| ***B41J 11/00*** | (2006.01) |
| ***B41J 15/16*** | (2006.01) |
| ***B41J 3/407*** | (2006.01) |

(52) U.S. Cl.

CPC ..... *B41J 11/002* (2013.01); *B41J 3/4078* (2013.01); *B41J 15/165* (2013.01); *B41J 11/0005* (2013.01)

(58) Field of Classification Search

USPC ..... 347/101, 102, 104

See application file for complete search history.

(56) References Cited

U.S. PATENT DOCUMENTS

| | | | | |
|---|---|---|---|---|
| 5,101,222 | A | 3/1992 | Hakkaku | |
| 8,434,849 | B2 | 5/2013 | Kurasawa et al. | |
| 8,459,790 | B2 | 6/2013 | Hara et al. | |
| 8,882,258 | B2 * | 11/2014 | Belbeck | B41J 3/60 347/102 |

FOREIGN PATENT DOCUMENTS

| | | |
|---|---|---|
| JP | 2011058130 | 3/2011 |

OTHER PUBLICATIONS

"Search Report of European Counterpart Application", dated Feb. 7, 2018, p. 1-p. 10.

* cited by examiner

*Primary Examiner* — Lam S Nguyen
(74) *Attorney, Agent, or Firm* — JCIPRNET

(57) ABSTRACT

To alleviate the trouble of the color developing step and achieve miniaturization. A color developer that heats and color develops a print medium, on which an ink is attached, is arranged. The color developer includes a transportation path in which a carry-in port and a carry-out port of the print medium are communicated to outside air, and the transportation path is extended in a direction intersecting a horizontal direction.

11 Claims, 9 Drawing Sheets

COLOR DEVELOPING MACHINE AND PRINTING DEVICE

CROSS REFERENCE TO RELATED APPLICATIONS

This application claims the priority benefit of Japanese Patent Application No. 2016-174971, filed on Sep. 7, 2016. The entirety of the above-mentioned patent application is hereby incorporated by reference herein and made a part of this specification.

TECHNICAL FIELD

The present disclosure relates to a color developing machine and a printing device equipped with the color developing machine.

DESCRIPTION OF THE BACKGROUND ART

A color developing machine that discharges ink to a print medium such as a cloth and carries out printing with an inkjet printer, and thereafter, color develops the ink attached to the print medium is known.

In a color developing step using the color developing machine, the print medium in which printing is finished and wound into a roll form is attached to a feed roller of the color developing machine, the print medium fed out from the feed roller is brought into contact with a heat generating roller to heat the print medium, and the heated print medium is wound with a winding roller (see e.g., Japanese Unexamined Patent Publication No. 2011-58130).

Patent Literature 1: Japanese Unexamined Patent Publication No. 2011-58130

SUMMARY

However, the conventional color developing machine requires setting a roll on the feed roller, and thus a print medium, on which the ink is attached, once needs to be wound into a roll form after the printing step, and thus is troublesome. Furthermore, the print medium wound into a roll form needs to be set on the feed roller of the color developing machine, and thus is troublesome.

Moreover, when configuring the inkjet printer and the color developing machine as one unit, the entire device tends to become large if the inkjet printer and the color developing machine are simply arranged in a line on an upstream side and a downstream side of a transporting direction of the print medium.

In view of the problems described above, the present disclosure provides a color developing machine that can alleviate the trouble of the color developing step and can achieve miniaturization, and a printing device equipped with the color developing machine.

In order to solve the problem described above, the present disclosure provides a color developing machine including a color developer that heats and color develops a print medium, on which an ink is attached, where the color developer includes a transportation path in which a carry-in port and a carry-out port of the print medium are communicated to outside air, and the transportation path extends in a direction intersecting a horizontal direction.

The color developing machine thus does not spread in the horizontal direction and the color developing machine can be compactly formed.

Furthermore, the transportation path is preferably extended in a vertical direction.

Thus, the air of the transportation path heated by the color developer is moved upward and can be discharged to the outside, whereby the heated air can be suppressed from remaining in the transportation path.

The color developer preferably includes a heating portion with a plurality of heaters, where at least a part of heaters out of the plurality of heaters are arranged along a width direction of the print medium to be transported or the transportation path, and a controller that independently carries out a heating control for every plural sets of heaters is preferably arranged. That is, the heating region can be divided along the width direction and/or the transportation path.

Thus, the heating condition of the print medium passing through the transportation path can be adjusted for every heating region, and color development can be carried out under a more optimum heating condition.

Furthermore, the controller preferably carries out a heating control of the heater, so that a heating amount from a heater located on a lowermost side becomes the largest.

Thus, the air entering from the lower side of the transportation path can be warmed. Since the air that enters has a lower temperature than the air in the transportation path, the lowering in heating efficiency by the entering air can be suppressed by increasing the heating amount on the lowermost side.

Furthermore, a reflecting member that reflects a heat released from the heater is preferably arranged at a position facing the transportation path with the heater in between, the reflecting member at a periphery of the heater being formed such that a distance from the heater to the reflecting member becomes equal.

Thus, the variation in heat reflected by the reflective member can be suppressed.

The color developer preferably includes wall portions that face each other with the transportation path in between, and one wall portion is preferably freely movable to move closer to or to move away from the other wall portion.

Thus, the maintenance of the color developer and the transportation path can be easily carried out.

The one wall portion is preferably freely movable along the horizontal direction.

Since the worker does not need to move the wall portion while receiving the weight of the wall portion, the work load of the maintenance can be alleviated.

The exhauster is preferably arranged on an upper side of the transportation path. The heated air in the transportation path thus can be effectively and efficiently discharged.

Furthermore, a flow-in portion for flowing the outside air to the transportation path may be provided on the lower side of the carry-in port.

The color developing machine further preferably includes a carry-in roller arranged on an upper side of the transportation path.

Thus, the heated air that moved upward from the transportation path can heat the carry-in roller, and the carry-in roller can be used as a preheating roller of the print medium.

In order to solve the problem described above, the present disclosure provides a printing device including a printing machine that attaches an ink to a print medium; and a color developing machine including a transportation path that extends in a direction intersecting a horizontal direction and in which a carry-in port and a carry-out port of a print medium are communicated to outside air, and being provided to heat and color develop the print medium on which the ink is attached.

Thus, the trouble of the color developing step can be alleviated, and miniaturization of the printing device can be achieved.

Furthermore, the color developing machine is preferably coupled with a position in a height direction freely adjustable with respect to the printing machine.

Thus, the coupling position can be appropriately adjusted according to the size of the printing machine.

According to the present disclosure, the trouble of the color developing step can be alleviated and miniaturization can be achieved.

DETAILED DESCRIPTION OF EMBODIMENTS

Hereinafter, an embodiment of the present disclosure will be described with reference to the drawings.

Figure 1:
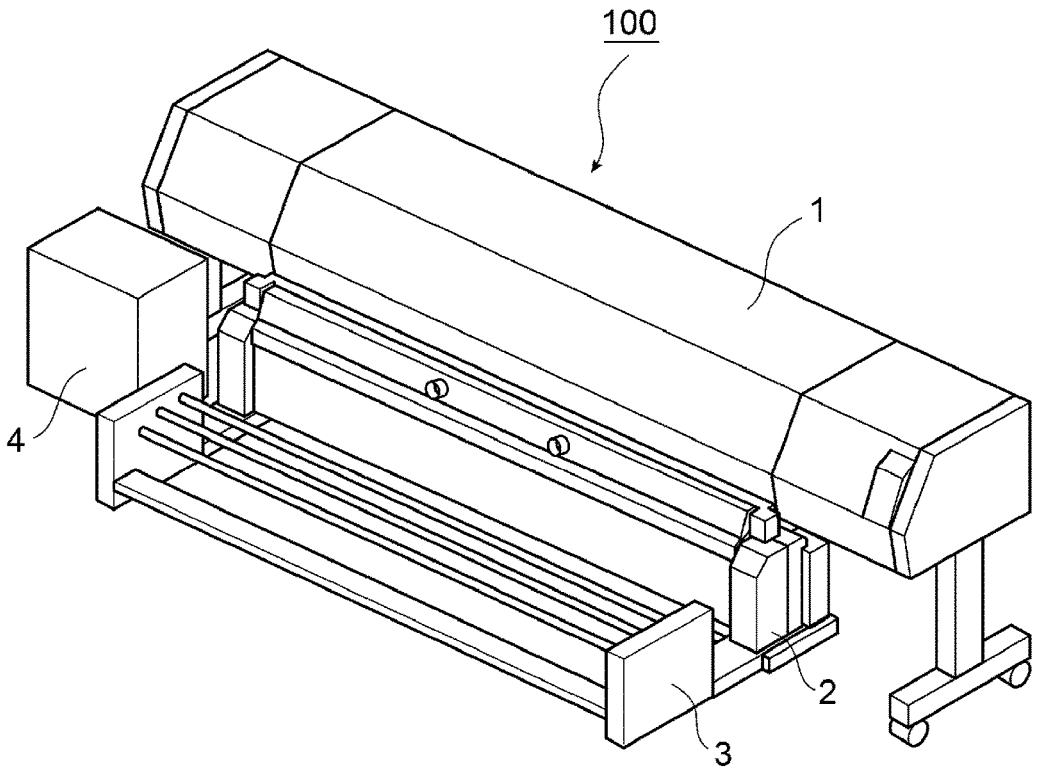
FIG. 1 is a perspective view of a printing device including a printing machine and a color developing machine.

As shown in FIG. 1, a printing device 100 includes a printing machine 1, a color developing machine 2, a winding device 3, and an ink supplying device 4. The printing machine 1 is, for example, an inkjet printer, and discharges ink from a recording head toward a print medium, and attaches the ink to the print medium. The color developing machine 2 heats the print medium, on which the ink is attached, and color develops the ink attached to the print medium. The winding device 3 winds the print medium in which the ink is color developed into a roll form. The ink supplying device 4 supplies ink to the printing machine 1. The printing device 100 has the printing machine 1 arranged on a most upstream side of a transportation path of the print medium, and the color developing machine 2 and the winding device 3 arranged side by side toward a downstream side of the transportation path of the print medium in such order. The ink supplying device 4 is arranged on a side (one end side in a width direction) of the printing machine 1.

<Printing Machine>

Figure 2:
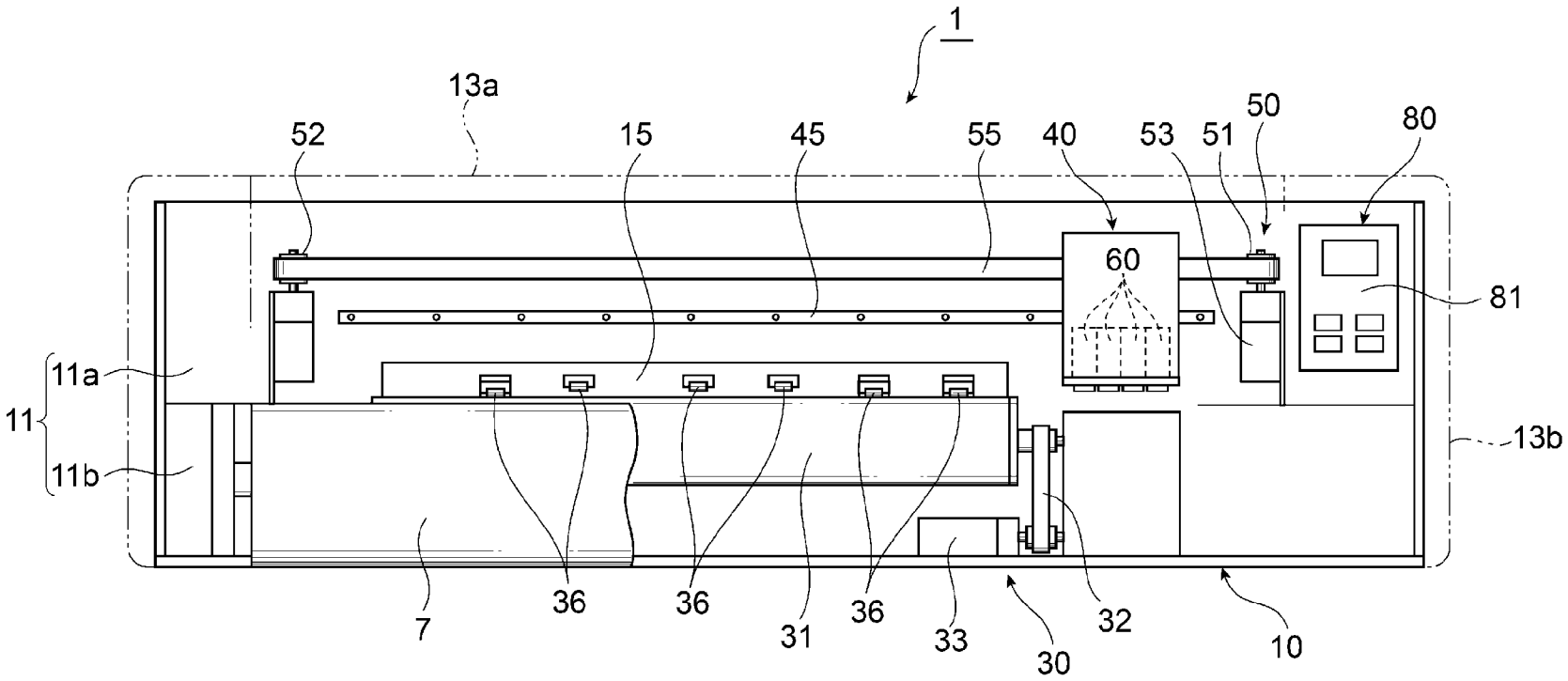
FIG. 2 is a front view in which one portion of the printing machine is enlarged.
Figure 3:
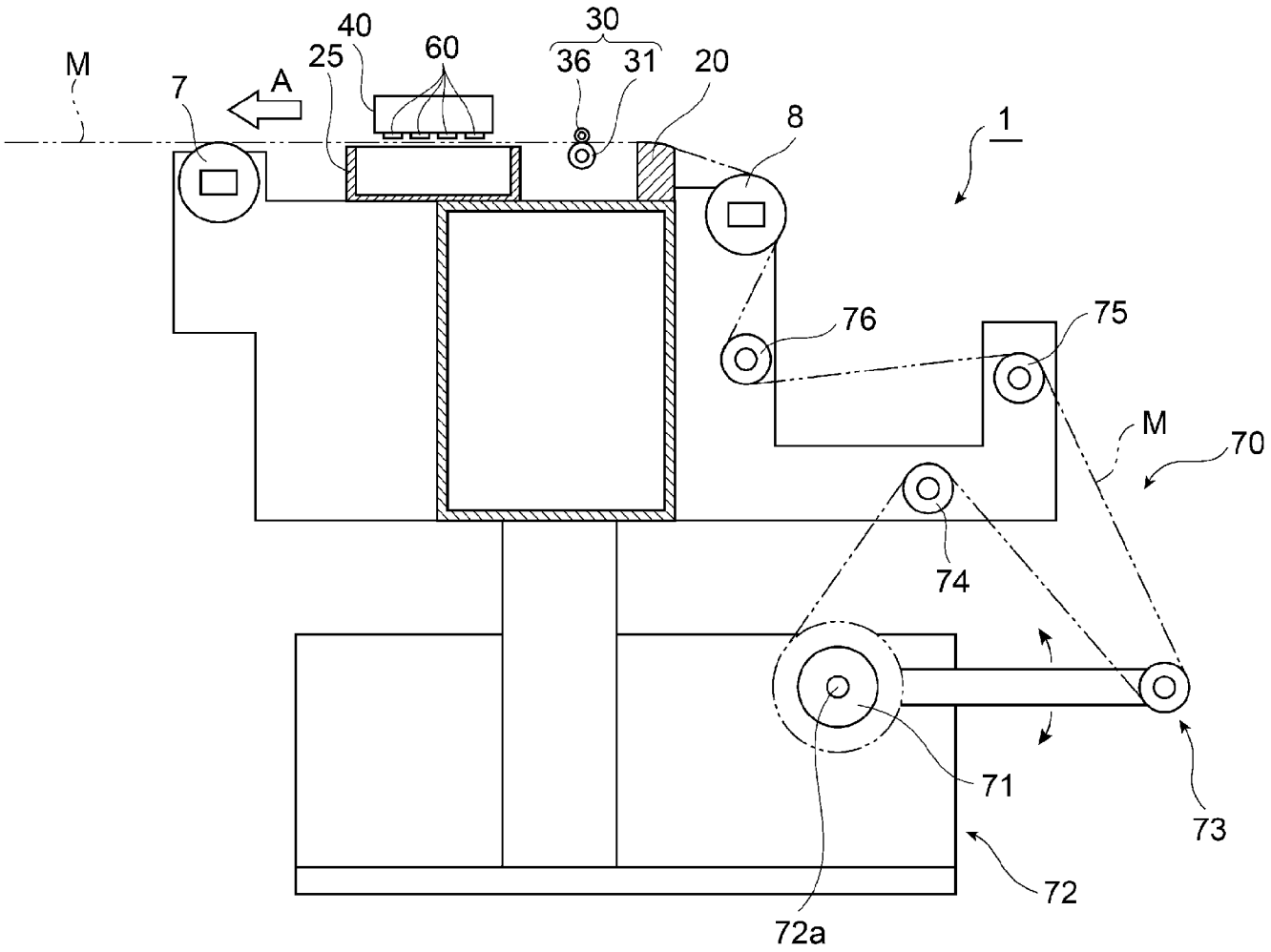
FIG. 3 is a side view showing an outline of the printing machine.
Figure 4:
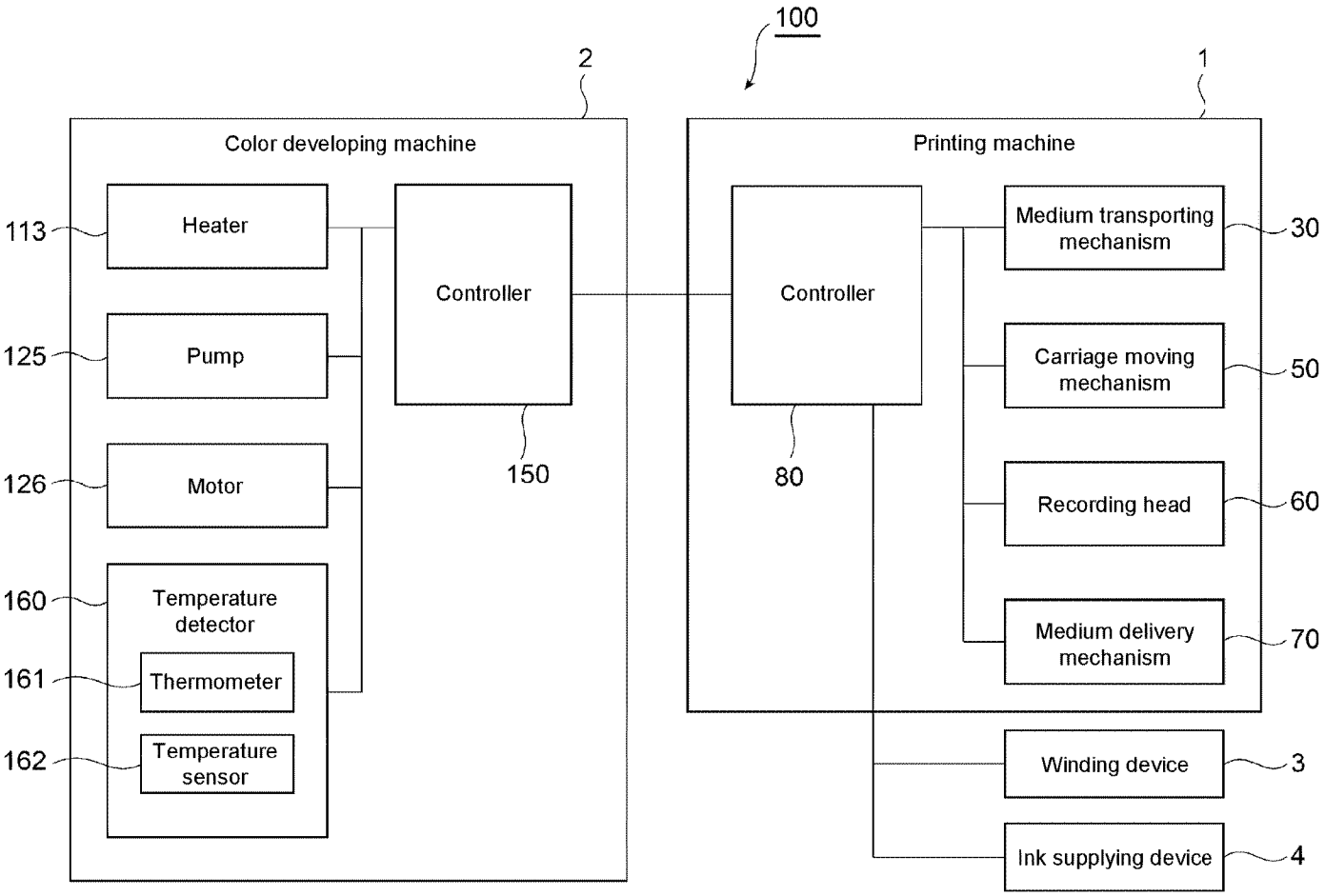
FIG. 4 is a block diagram describing a configuration controlled by a controller of the printing device.

As shown in FIGS. 2 to 4, the printing machine 1 includes a body 10, a medium supporting portion 20, a medium transporting mechanism 30, a carriage 40, a carriage moving mechanism 50, a recording head 60, a medium delivery mechanism 70, and a controller 80.

(Body)

The body 10 constitutes an attachment base of each portion, and includes a main body frame 11 including an upper frame 11*a* provided with a roller assembly of the medium transporting mechanism 30 and a supporting structure of the carriage 40, and a lower frame 11*b* provided with the feed roller of the medium supporting portion 20, the medium transporting mechanism 30, and the like. A medium inserting portion 15 having a horizontally long window shape through which the print medium M can be inserted forward and backward is formed between the upper frame 11*a* and the lower frame 11*b*. The body 10 is formed to a horizontally long rectangular box shape as a whole that is surrounded with a front cover 13*a* that covers a central part of the main body frame 11 and a side cover 13*b* that covers the left and right.

(Medium Supporting Portion)

The medium supporting portion 20 is arranged at a position between a brake roller 8 (to be described later) and the medium transporting mechanism 30 on the transportation path of a print medium M, and supports the print medium M at the relevant position and horizontally feeds the print medium M toward the medium transporting mechanism 30. A medium supporting surface, which is an upper surface of the medium supporting portion 20, is formed to a smooth curve shape from a front end side toward a back end side, and may be provided with a mechanism for absorbing and holding the print medium M, as necessary.

(Medium Transporting Mechanism)

The medium transporting mechanism 30 moves the print medium M supported by the medium supporting portion 20 back and forth. The medium transporting mechanism 30 is configured to include a cylindrical feed roller 31 turnably provided about a turning shaft extending to the left and right, and a plurality of pinch rollers 36 elastically engaged with the feed roller 31, where the print medium M is transported in a predetermined direction by a feeding amount corresponding to a rotation angle of the feed roller 31, that is, the feeding amount corresponding to a drive control value output from the controller 80 by turning the feed roller 31 with the print medium M sandwiched between upper and lower rollers 36, 31.

As a mechanism for driving, it is configured including a servo motor 33 that rotatably drives the feed roller 31, a timing belt 32 that is bridged across a driven pulley coupled to a shaft end of the feed roller 31 and a drive pulley coupled to a shaft end of the servo motor 33, and the like.

As shown in FIG. 3, the print medium M is transported in air between the medium transporting mechanism 30 and a tension roller 7, and the ink is discharged from the recording head 60 with respect to the print medium M to carry out printing. In this case, a constant tension is applied on the print medium M by the tension roller 7 and the brake roller 8. The transporting direction of the print medium M is indicated with an arrow A.

A guide rail 45 extending to the left and right in parallel with the feed roller 31 is attached to the upper frame 11*a*, and the carriage 40 holding the recording head 60 is supported so as to freely move to the left and right by the guide rail 45. The guide rail 45 is a supporting rail of a direct acting bearing, where the carriage 40 is fixed to a slide block fitted to the guide rail 45 and supported to freely slidably move to the left and right, and moved to the left and right by the carriage moving mechanism 50.

(Carriage, Carriage Moving Mechanism)

The carriage 40 supports the recording head 60, and is located on the upper side of the medium supporting portion 20 to be supported so as to freely move to the left and right.

The carriage moving mechanism 50 relatively moves the carriage 40 to the left and right with respect to the print medium M transported in air. The carriage moving mechanism 50 includes a drive pulley 51 and a driven pulley 52 arranged in the vicinity of left and right side ends of the guide rail 45, a servo motor 53 that rotatably drives the drive pulley 51, and an endless belt-like timing belt 55 bridged across the drive pulley 51 and the driven pulley 52, and is configured with the carriage 40 coupled and fixed to the timing belt 55. The rotation of the servo motor 53 is controlled by the controller 80, and the carriage 40 is moved to the left and right by a feeding amount corresponding to the drive control value output from the controller 80 to the servo motor 53.

(Recording Head)

The recording head 60 is arranged with a predetermined gap from the print medium M on a lower surface of the carriage 40. The arrangement configuration of the recording head 60 has various modes and can use an appropriate configuration, but in the present embodiment, a head configuration in which a total of eight recording heads 60, that is, the recording head 60, each having the nozzle row, in which a great number of nozzles that sprays microscopic ink particles are linearly aligned in a front and back direction, lined in parallel, is lined by fours in the front and back direction and in the left and right direction.

An ink receiving portion 25 is arranged on the lower side of the movement path of the recording head 60. When a cloth is used for the print medium M, for example, the ink receiving portion 25 has a function of accumulating the ink discharged from the recording head 60 and passed through the print medium M, and discharging the ink.

(Medium Delivery Mechanism)

The medium delivery mechanism 70 includes a supporting portion 72 that supports a tubular winding tube 71, around the periphery of which the print medium M in a non-processed state is wound to a roll form, in a freely rotatable and detachable manner, a first tension applying portion 73 that applies a tension (tensile force) in a direction opposite the transporting direction on the print medium M between the winding tube 71 and the brake roller 8, and a plurality of guide rollers (first guide roller 74, second guide roller 75, third guide roller 76) that smoothly guide the print medium M supplied from the winding tube 71 to the brake roller 8. The supporting portion 72 includes a shaft portion 72*a* fixed to the winding tube 71 and a stepping motor (not shown) in which the shaft portion 72*a* is coupled to a rotation shaft, and delivers the print medium M by a delivery amount corresponding to a drive control value output from the controller 80 to the stepping motor.

(Controller)

The controller 80 controls the drive of each portion of the printing machine 1 such as the front and back movement of the print medium M by the medium transporting mechanism 30, the left and right movement of the carriage 40 by the carriage moving mechanism 50, the ink injection from each nozzle of the recording head 60, the delivery operation of the print medium M in a non-processed state by the medium delivery mechanism 70, and the like. The controller 80 combines the front and back movement of the print medium M by the medium transporting mechanism 30 and the left and right movement of the carriage 40 by the carriage moving mechanism 50 to relatively move the print medium M and the recording head 60, and discharges the ink from each nozzle of the recording head 60 to the print medium M to print characters, figures, and the like corresponding to the print program and the print data.

The controller 80 includes a memory (storage portion) that stores a preset and recommended temperature of a transportation path 114, heating time of the print medium M, and ink density, and the controller 80 carries out various computations using the data stored in the memory.

The controller 80 is arranged on an upper part of the right side of the body 10 and has a liquid crystal display for displaying various types of information, and various types of operation buttons such as a function key for selecting a function to set, a jog key for selecting an execution content, an enter key for inputting the selected content and a clear key for clearing the setting provided on an operation panel 81 arranged to be operable from the front side of the body 10. Thus, the operator can set the print conditions while checking the display content of the liquid crystal display, and execute the printing.

Furthermore, as shown in FIG. 4, the controller 80 is connected to a controller 150 of the color developing machine 2, to be described later, and can adjust a conducting amount of a heater 113 of the color developing machine 2 with the controller 80 of the printing machine 1. The adjustment of the conducting amount does not only mean increasing/decreasing a current value to flow to the heater 113, and also includes stopping the conduction to the heater 113, turning OFF the power supply of the heater 113, and switching the power supply of the heater 113 from OFF to ON.

<Color Developing Machine>

The color developing machine 2 is arranged so as to be adjacent on the downstream side of the printing machine 1 (downstream side in the transporting direction of the print medium M). The color developing machine 2 is coupled in a manner the position in the height direction can be freely adjustable with respect to the printing machine 1. Specifically, the printing machine 1 and the color developing machine 2 are respectively formed with a plurality of bolt holes, and the respective bolt holes are aligned at an arbitrary position and tightened with a bolt and a nut so that the color developing machine 2 can adjust the position in the height direction with respect to the printing machine 1.

As shown in FIGS. 4 to 9, the color developing machine 2 includes a color developer 110, an exhauster 120, a heat insulator 140, and a controller 150, and a temperature detector 160.

(Color Developer)

The color developer 110 heats the print medium M, on which the ink is attached, transported from the printing machine 1 to color develop the ink.

The color developer 110 is arranged on a building frame 111, and includes two wall portions 112*a*, 112*b*, which face each other, a heating portion 113 arranged on each wall portion 112*a*, 112*b*, a transportation path 114 of the print medium M, a reflective member 115, and a net member 116.

Figure 5:
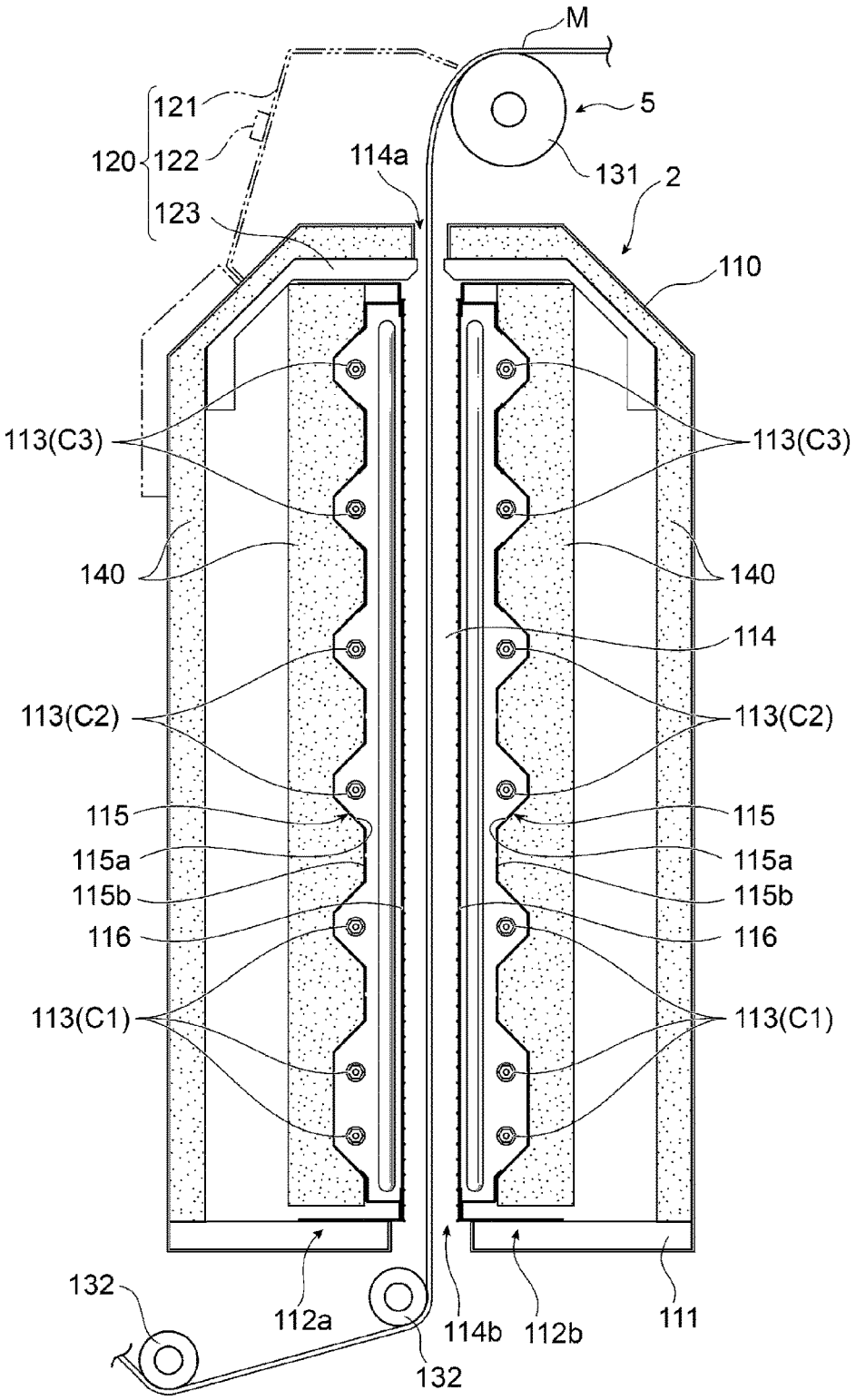
FIG. 5 is a view describing an internal structure of the color developing machine.

As shown in FIG. 5, the wall portions 112*a*, 112*b* are arranged so as to face each other with an interval that at least allows the print medium M to be transported therethrough. The wall portion 112*a*, 112*b* is arranged on the building frame 111 such that the wall surface lies in a vertical direction.

A space formed between the wall portion 112*a* and the wall portion 112*b* is the transportation path 114 in which the print medium M is transported. When transporting the print medium M, the transportation path 114 is formed to an interval of an extent the print medium M does not make contact with the wall portions 112*a*, 112*b*. In other words, the wall portion 112*a* and the wall portion 112*b* are arranged to face each other with the transportation path 114 in between. The transportation path 114 is extended to lie along a direction intersecting a horizontal direction, for example, a vertical direction, where one end of the transportation path 114 is communicated to outside air toward the upper end side of the color developer 110, and the other end of the transportation path 114 is communicated to outside air toward the lower end side of the color developer 110. An opening on the upper end side in the transportation path 114 is a carry-in port 114*a* of the print medium M, and an opening on the lower end side is a carry-out port 114*b* of the print medium M.

One wall portion 112*a* is freely movable so as to move closer to or move away from the other wall portion 112*b* along the horizontal direction. The other wall portion 112*b* is fixed to the body frame 111.

Figure 6:
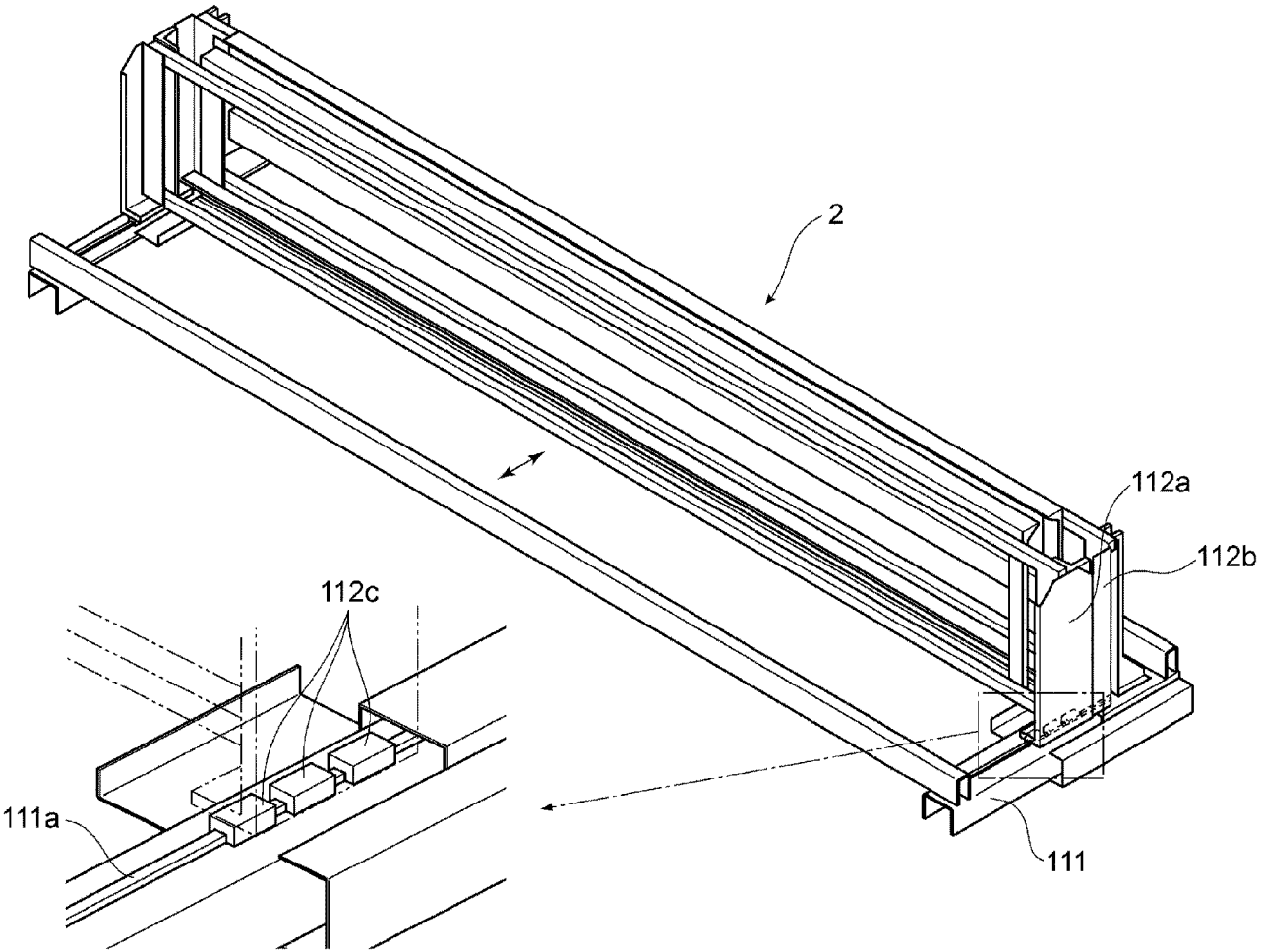
FIG. 6 is a view describing a moving mechanism of a wall portion.
Figure 7:
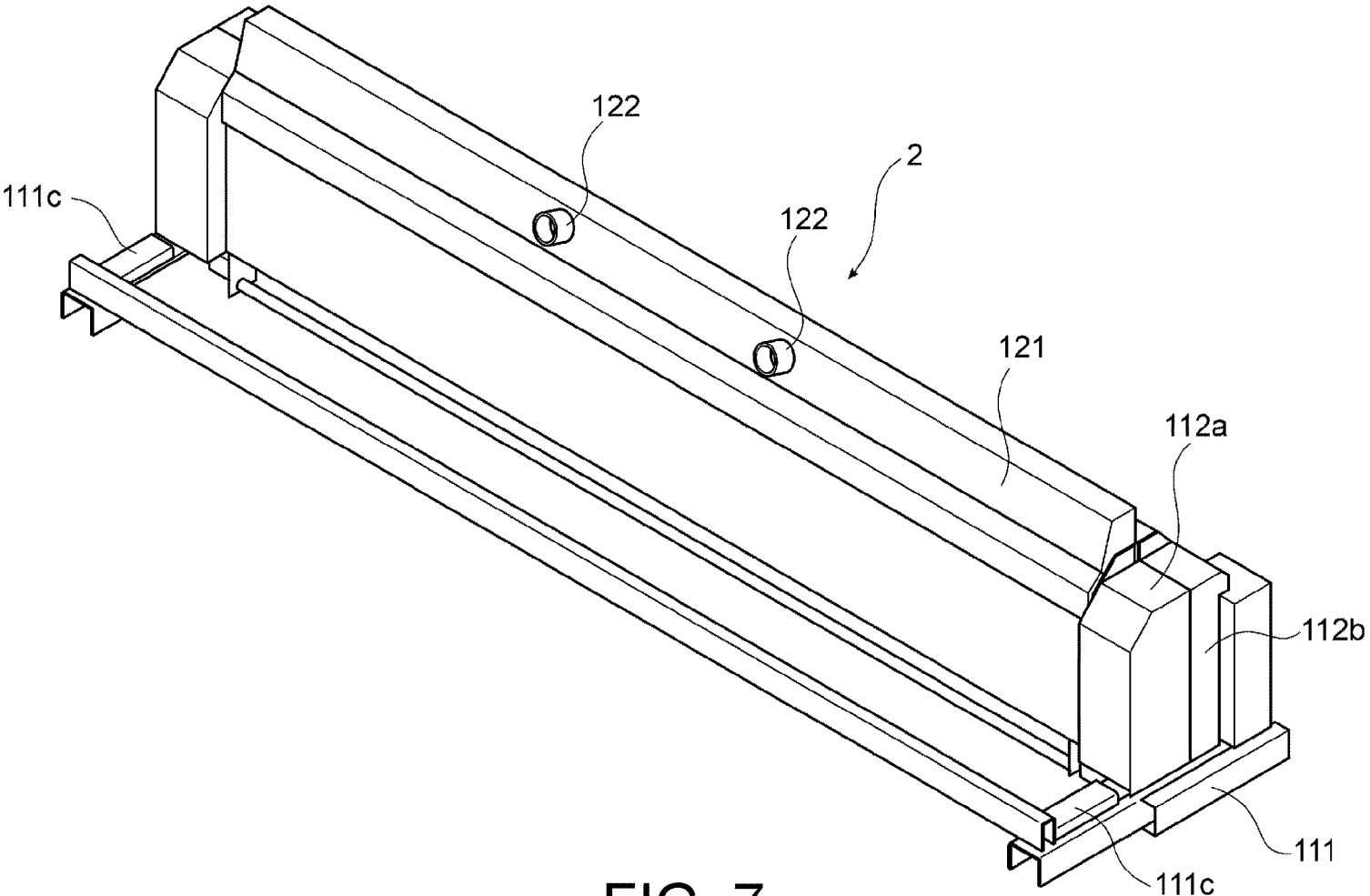
FIG. 7 is a view describing a state in which the movement of the wall portion is regulated.

As shown in FIG. 6, a platform portion 112*c* formed with a groove is provided at the lower end of the wall portion 112*a*. The platform portion 12*c* has the groove fitted in a freely moving manner to the rail 111*a* laid on the building frame 111. The rail 111*a* is laid on the building frame 111 so that the wall surface of the wall portion 112*a* linearly extends along a direction of moving closer to or moving away from the wall surface of the wall portion 112*b*. Thus, the wall portion 12*a* is freely movable along the rail 111*a*, and can move closer to or away from the wall portion 112*b* fixed to the building frame 111. When regulating the movement of the wall portion 112*a*, the wall portion 112*a* can be fixed on the rail 111*a* by placing the cover 111*c* over the rail 111*a*, as shown in FIG. 7.

The heating portion 113 is arranged on both the wall portion 112*a* and the wall portion 112*b*. The heating portion 113 is, for example, a heater 113 that generates heat by conduction and radiates heat to the periphery. The heater 113 is, for example, formed to a rod shape, where a plurality of heaters 113 are arranged on each wall portion 112*a*, 112*b*. As shown in FIG. 5, some heaters 113 are arranged so as to be lined in plurals with, for example, the longitudinal direction thereof lying along a width direction of the print medium M, that is, a direction orthogonal to the transporting direction of the print medium M. The heaters 113 arranged in a line along the width direction of the transportation path 114 are arranged at an equal interval excluding the heater 113 in the lowermost level. The heater 113 in the lower level is arranged so that the interval is shorter than the other heaters 113. This is because the heated air in the transportation path 114 moves upward, and hence the lowering in temperature is to be reduced as much as possible so that the inside of the transportation path 114 is not cooled by the air entering from the carry-out port 114*b*.

Figure 9:
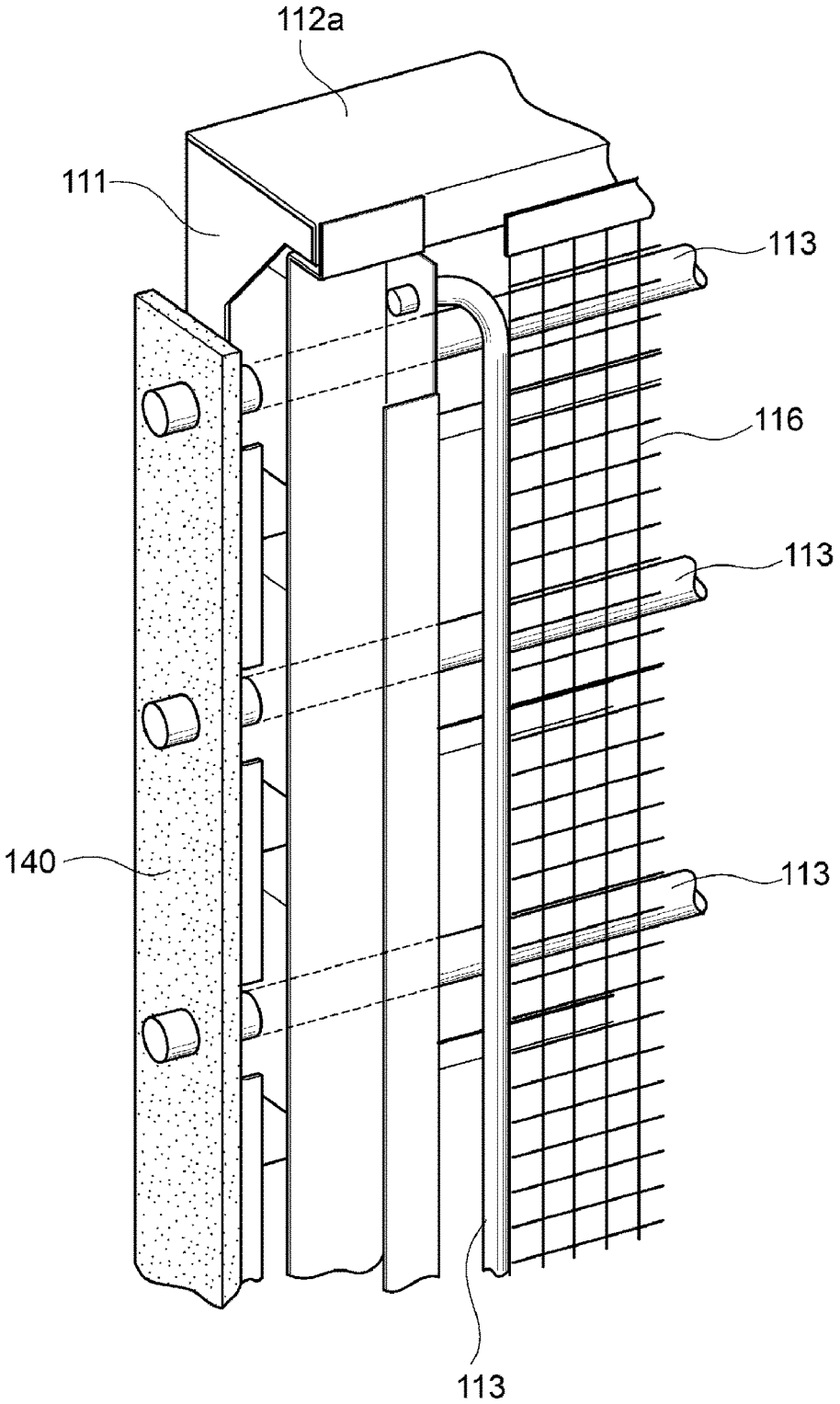
FIG. 9 is a view describing a structure of both ends of a heater.

Furthermore, as shown in FIGS. 5 and 9, some heaters 113 are arranged so as to be lined in plurals with the longitudinal direction thereof lying along the transporting direction (direction of transportation path 114) of the print medium M. Specifically, a total of two are arranged, one on each outer side of both ends of the heater 113 arranged along the width direction of the transportation path 114. This is to reduce the lowering of temperature as much as possible so that the inside of the transportation path 114 is not cooled by the air entering from both ends of the heater 113.

Thus, the transportation path 114 is in a state the periphery is surrounded by the heater 113, and has a structure in which the transportation path 114 is not easily cooled by the air entering from the periphery even if the air warmed by the heater 113 escapes upward from the carry-in port 114*a*.

As shown in FIG. 5, the reflective member 115 reflects the heat released from the heater 113 toward the transportation path 114, and is provided on each wall portion 112*a*, 112*b*. The reflective member 115 is arranged at a position facing the transportation path 114 with the heater 113 in between. The reflective member 115 is a plate material made of metal formed with an accommodating portion 115*a* for accommodating the heater 113 arranged along the width direction of the transportation path 114, and is, for example, made from a stainless steel plate. The accommodating portion 115*a* of the reflective member 115 is formed such that the distance from the surface of the heater 113 to the surface of the accommodating portion 115*a* becomes substantially equal. Specifically, the reflective member 115 is formed such that a flat plate portion 115*b* other than the accommodating portion 115*a* becomes substantially in plane with the surface closest to the transportation path 114 in the heater 113. The accommodating portion 115*a* is linearly inclined from the flat plate portion 115*b* toward the rear surface side of the heater 113 (side away from the transportation path 114), and is formed to a planar shape along the surface direction of the flat plate portion 115*b* on the rear surface side of the heater 113. In other words, the accommodating portion 115*a* forms a space having a trapezoidal shape in side view.

The accommodating portion 115*a* on the lowest is formed to be greater than the other accommodating portions 115*a* so as to accommodate two heaters 113. The net member 116 is arranged on each wall portion 112*a*, 112*b*.

The net member 116 is arranged to partition the transportation path 114 and the heater 113, so that even in an event the heater 113 drops, the heater 113 will not come into contact with the print medium M.

(Exhauster)

The exhauster 120 discharges the air heated by the heater 113, and moved to the upper side of the carry-in port 114*a* from the inside of the transportation path 114 to the outside.

As shown in FIGS. 4, 5, 7, and 8, the exhauster 120 includes a cover 121, an intake port 122, an exhaust duct 123, and a pump 125.

Figure 8:
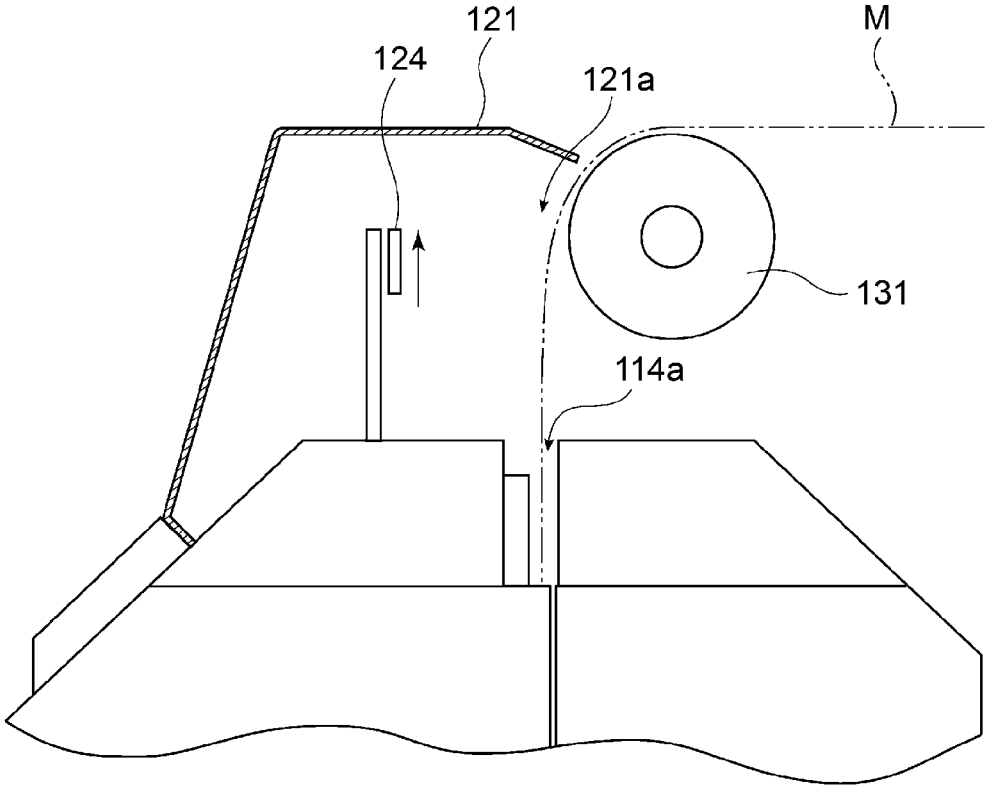
FIG. 8 is a view describing an arrangement of a carry-in port, an exhauster, and a carry-in roller of the transportation path.

The cover 121 is arranged in the vicinity of the upper end of each wall portion 112*a*, 112*b*, and is arranged to cover the space of the entire region in the width direction (width direction of the print medium M to be transported) of the color developer 110. Each cover 121 is arranged such that the respective ends face each other, where the upper side of the carry-in port 114*a* is arranged with an interval for allowing the print medium M to pass therethrough. Each cover 121 has a surface facing the print medium M transported toward the carry-in port 114*a* opened. A shielding member 124 that opens/closes the opening 121*a* is arranged at the opening 121*a* of the cover 121. As shown in FIG. 8, the shielding member 124 is arranged in plurals along the width direction of the cover 121, and shields the opening 121*a* according to the size of the print medium M to be transported. The shielding member 124 is open/close controlled by the controller 150 so that the shielding member 124 of the region not facing the print medium M to be transported shields the opening 121*a*.

The print medium M is transported such that the center in the width direction thereof coincides with the center in the width direction of the carry-in port 114*a*, and hence if the size of the print medium M is small, the shielding member 124 shields the opening 121*a* from those at both ends in the width direction of the cover 121.

The intake port 122 is arranged on the rear surface side of the cover 121 (side opposite the opening 121*a*) to take in the air in the space on the upper side of the carry-in port 114*a*. When taking in air, the air in the cover 121 is suctioned with the pump 125 (see FIG. 4) so that the air is discharged from the intake port 122.

The exhaust duct 123 discharges the air taken in from the intake port 122 to the outside. The exhaust duct 123 is arranged at the upper part of the color developer 110 and is communicated to the intake port 122. The exhaust duct 123 is a conduit that guides the air suctioned through the intake port 122 to the outside.

The pump 125, for example, is arranged in the exhaust duct 123 to discharge the air in the exhaust duct 123 to the outside.

A flow-in portion may be provided on the carry-out port 114*b* side to enhance the exhaust effect in the transportation path 114 by the exhauster 120. The air in the transportation path 114 is easily flowed by sending air from the flow-in portion, so that the exhaust effect by the exhauster 120 can be promoted. In this case, the pump 125 connected to the exhauster 120 may also be used in the flow-in portion.

(Heat Insulator)

The heat insulator 140 is provided so that the heat released from the heater 113 is not radiated as much as possible to the outside of the color developing machine 2. The heat insulator 140 is formed by, for example, felt.

As shown in FIGS. 5 and 9, the heat insulator 140 is arranged on the back surface of the surface facing the heater 113 in the reflective member 115. The heat insulator 140 is arranged on the building frame 111 of the wall portion 112*a*, 112*b*, to which the reflective member 115 is attached. The heat insulator 140 is arranged so as to continue from the outer surface of the exhaust duct 123 to the outer surface of the building frame 111. The heat insulator 140 is arranged along the extending direction of the transportation path 114 so as to cover both ends of the heater 113 arranged along the width direction of the transportation path 114. Thus, the heat insulator 140 is arranged on the top, bottom, left, right, and rear of the heater 113, whereby a structure in which the heat released from the heater 113 is less likely to escape to the outside is obtained.

(Controller)

The controller 150 controls the drive of each portion of the color developing machine 2.

As shown in FIG. 4, the controller 150 controls ON/OFF, conducting amount, conducting time, and the like of the conduction to the heater 113 to control the heating of the print medium M of the transportation path 114. The controller 150 independently carries out heating control for every plural sets of heaters 113. Specifically, assuming two heaters 113 from the upper side form one set, and three heaters 113 form one set at the lowermost level, a total of three sets of heater groups are independently controlled. The controller 150 carries out the heating control so that the heating amount by the heater 113 group (C1, C2, C3), in which three heaters form one set at the lowermost level, becomes the largest. In other words, the lower side of the transportation path 114 can be strongly heated and the entering air can be warmed as fast as possible by having the conducting amount greater than the other sets or having the conducting time longer than the other sets. Furthermore, as the heated air moves upward, the heating amount of the other sets can be reduced.

The heating control by the controller 150 is not limited to being carried out such that the heating amount on the lower side becomes the largest, and an area of the heater 113 where the heating amount is to be the largest can be changed according to the print condition, the type of print medium M and the like.

The controller 150 controls the drive (ON/OFF) of the pump 125 of the exhauster 120. The controller 150 controls the opening/closing operation of the shielding member 124 of the exhauster 120. Specifically, the controller 150 controls the drive of the motor 126 for driving the shielding member 124.

(Temperature Detector)

The temperature detector 160 includes a thermometer 161 of a thermocouple, and the like that detects the temperature in the transportation path 114, and a contactless temperature sensor 162 that detects the temperature of the surface of the print medium M in the transportation path 114. Two temperature detectors 160 do not necessarily need to be provided, but the thermometer 161 and the temperature sensor 162 are used to carry out the temperature management more accurately.

The thermometer 161 and the temperature sensor 162 are, for example, arranged on the reflective member 115.

The thermometer 161 and the temperature sensor 162 are both connected to the controller 150, and the controller 150 controls the conducting amount to the heater 113 according to the detected temperature.

<Winding Device>

The winding device 3 is configured similar to the medium delivery mechanism 70, and includes a winding tube (not shown) that winds the print medium M, on which printing is finished, into a roll form, and a supporting portion (not shown). The supporting portion includes a shaft portion (not shown) fixed to the winding tube, and a stepping motor (not shown) in which the shaft portion is coupled to a rotation shaft, and winds the print medium M by a winding amount corresponding to a drive control value output from the controller 80 to the stepping motor.

<Transportation Portion>

The print medium M is transported through the transportation path 114 of the color developing machine 2 by the delivery of the print medium M by the medium delivery mechanism 70, the transportation of the print medium M by the medium transporting mechanism 30, and the winding of the print medium M by the winding device 3. In other words, the printing machine 1 and the winding device 3 configure the transportation portion 5.

As shown in FIGS. 5 and 8, the transportation portion 5 includes a carry-in roller 131 and a carry-out roller 132.

The carry-in roller 131 is also used as a tension roller 7 of the printing machine 1, and is arranged on the upper side of the carry-in port 114*a*. The carry-in roller 131 (tension roller 7) is a guide roller that guides the transporting direction of the print medium M, and rotates about a shaft with the winding of the print medium M by the winding device 3 arranged adjacent to the color developing machine 2. The carry-in roller 131 is arranged so as to have a line extending upward along the vertical direction from the carry-in port 114*a* as a tangent line, and changes the transporting direction of the print medium M hooked at an outer peripheral surface so as to lie in the vertical direction to transport the print medium from the carry-in port 114*a* into the transportation path 114.

The carry-out roller 132 is a guide roller arranged in the winding device 3 to change the transporting direction of the print medium M, and is arranged on the lower side of the carry-out port 114*b*. The carry-out roller 132 rotates about a shaft with the winding of the print medium M by the winding device 3 arranged adjacent to the color developing machine 2. One of the carry-out rollers 132 is arranged so as to have a line extending downward along the vertical direction from the carry-out port 114*b* as a tangent line, and changes the transporting direction of the print medium M hooked at an outer peripheral surface to transport the print medium M toward the winding device 3. A process for enhancing the friction force of the print medium M and the carry-out roller 132 is performed on the outer peripheral surface of the carry-out roller 132 where the print medium M is hooked. Specifically, a resin gigging sheet is arranged on the surface of the carry-out roller, or process for roughening the surface roughness of the outer peripheral surface of the carry-out roller 132 is carried out. In addition, a projection may be formed on the outer peripheral surface of the carry-out roller 132, or an adhesive material that can easily attach/detach the print medium M may be provided on the outer peripheral surface. Such processing of the outer peripheral surface of the carry-out roller 132 may be applied on the carry-in roller 131.

The printing device 100 having the configuration described above can transport the print medium M discharged from the printing machine 1 to the color developing machine 2 as is without being wound, and hence the feed roller does not need to be arranged in the color developing machine 2 and the work for once winding the print medium M to a roll form and arranging the same on the feed roller also is not necessary, whereby the trouble can be greatly reduced. Furthermore, since the transportation path 114 of the print medium M is formed to extend along the vertical direction, the color developing machine 2 does not spread in the horizontal direction (lateral direction) and the color developing machine 2 can be compactly formed, and the printing device 100 does not become huge even if the printing machine 1 and the color developing machine 2 are integrally formed. Thus, the trouble of the color developing step can be alleviated, and miniaturization of the color developing machine 2 and the printing device 100 can be realized.

The color developing machine 2 is formed so that the extending direction of the transportation path 114 of the print medium M lies in the vertical direction, so that the air (includes vapor generated when the ink of the print medium M is heated) of the transportation path 114 heated by the heater 113 moves upward and can be discharged to the outside from the carry-in port 114*a* of the print medium M, whereby the heated air (vapor) does not remain in the transportation path 114.

At least a part of heaters 113 out of the plurality of heaters 113 are arranged in plurals along the width direction of the print medium M, so that the print medium M can be heated at any position in the transportation path 114.

At least a part of heaters 113 out of the plurality of heaters 113 are arranged along both ends of the heater 113 arranged along the width direction of the print medium M, that is, along the transportation path 114, so that the transportation path 114 can be surrounded with the heater 113 and the heat in the transportation path 114 is unlikely to escape to the outside.

The heater 113 can be independently controlled for every plural sets by the controller 150, so that the heating condition of the print medium M passing through the transportation path 114 can be more finely adjusted.

As the transportation path 114 is extended in the vertical direction, the heat is gathered on the upper side, the variation in temperature in the transportation path 114 can be suppressed by increasing the output of the heater 113 (C1) of the set at the lower level with the controller 150.

Since the reflective member 115 is arranged on the rear surface side of the heater 113, the heat released toward the outside of the transportation path 114 can also be reflected toward the transportation path 114 by the reflective member 115, and the heating efficiency of the transportation path 114 can be enhanced. In particular, the variation in heat reflected by the reflective member 115 can be suppressed by having the distance from the surface of the heater 113 to the reflective member 115 substantially equal.

One wall portion 112*a* is configured to freely slidably move along the horizontal direction so as to move closer to or move away from the other wall portion 112*b*, so that maintenance of the heater 113 and the transportation path 114 can be easily carried out. Furthermore, since the wall portion 112*a* is moved along the rail 111*a*, the worker does not need to move the wall portion 112*a* while receiving the weight of the wall portion 112*a*, and thus the work load of the maintenance can be alleviated.

As the exhauster 120 is arranged on the upper side of the carry-in port 114*a*, the heated air released from the transportation path 114 can be guided to the outside of the color developing machine 2, and hence the air at the periphery of the printing machine 1 and the color developing machine 2 is less likely to be polluted.

The shielding member 124 is arranged on the cover 121 of the exhauster 120, so that the shielding member 124 can be opened/closed according to the size of the print medium M to efficiently discharge the air to the outside.

Since the carry-in roller 131 is arranged on the upper side of the carry-in port 114*a*, the heated air that moved upward from the transportation path 114 can heat the carry-in roller 131, and the carry-in roller 131 can be used as a preheating roller of the print medium M.

The carry-out roller 132 has the outer peripheral surface performed with the process of enhancing the friction force with the print medium M, and thus production of folds and wrinkles due to shrinkage of the print medium M heated in the transportation path 114, and the like can be suppressed.

The heat insulator 140 is arranged to cover the building frame 111 exposed to the outside, the outer side of the reflective member 115, and both ends of the heater 113, so that the heat released from the heater 113 can be suppressed from escaping to the outside.

The color developing machine 2 is coupled so that the position in the height direction is freely adjustable with respect to the printing machine 1, and thus the coupling position can be appropriately adjusted according to the size of the printing machine 1 and the range of model type of the printing machine 1 to which the color developing machine 2 can be applied can be increased.

The present disclosure is not limited to the embodiment described above, and can be appropriately changed. The arrangement, shape, and the like of each portion of the color developing machine are arbitrary, and can be freely changed within a scope the functions described above can be exhibited.

For example, the extending direction of the transportation path 114 is not limited to the vertical direction, and may be the horizontal direction and a direction intersecting the vertical direction. Furthermore, the heater 113 does not need to be arranged on both wall portions 112*a*, 112*b*, and merely needs to be arranged on at least one wall portion 112*a*, 112*b*. The heater 113 may, of course, be arranged to surround the outer edge of the wall portion 112*a*, 112*b*, but if the output of each heater 113 is sufficiently large, some heaters 113 may be omitted. The number and the installation interval of the heaters 113 are arbitrary, and can be freely changed.

The reflective member 115 is not limited to including the accommodating portion 115*a* forming a space having a trapezoidal shape in side view, and may be formed to include an accommodating portion forming a space having a semicircular shape in side view. The material for forming the reflective member 115 is also arbitrary, and any material may be used as long as it reflects heat from the heater 113.

The shielding member 124 is not limited to being open/close controlled by the controller 150, and may be appropriately carried out manually in accordance with the size of the print medium M to be transported.

The pump 125 that discharges the air in the exhaust duct 123 may be replaced with a fan, and the like.

The heat insulator 140 is not limited to a felt of a fiber heat insulating material, and may be glass wool, and the like, or a foam heat insulating material such as urethane foam, polystyrene foam, foamed rubber, and the like.

The controller 150 may be arranged to control the color developing machine 2, or the controller arranged in the printing device 100 may carry out the control of the printing machine 1 and the color developing machine 2. Furthermore, the controller 80 arranged in the printing machine 1 may carry out the control of the color developing machine 2.

What is claimed is:

1. A color developing machine, which is arranged to be adjacent on a downstream side of a printing machine, and the downstream side of the printing machine is a downstream side in a transportation direction of a print medium, and the color developing machine comprising:

a color developer that is configured to heat and color develop a print medium, on which an ink is attached, wherein the color developer includes a transportation path in which a carry-in port and a carry-out port of the print medium are in communication with outside air, the transportation path extending in a direction intersecting a horizontal direction;

wherein the color developer includes:

a heating portion with a plurality of heaters, at least a part of heaters out of the plurality of heaters are arranged along a width direction of the print medium to be transported or the transportation path, and a controller that independently carries out a heating control for every plural sets of heaters is arranged;

wherein the color developer is configured to heat the print medium on which the ink is attached, transported from the printing machine to color develop the ink;

wherein the plurality of the heaters are arranged side by side along a direction orthogonal to the transporting direction of the print medium; and among the plurality of the heaters, the heaters located on a lowermost side are arranged with a first interval that is shorter than a second interval of the other heaters.

2. The color developing machine according to claim 1, wherein the transportation path is extended in a vertical direction.

3. The color developing machine according to claim 1, wherein the controller is configured to carry out the heating control of the heaters, so that a heating amount from the heater located on the lowermost side becomes the largest.

4. The color developing machine according to claim 1, further comprising:

a reflecting member that is configured to reflect a heat released from the heater is arranged at a position facing the transportation path with the heater in between, the reflecting member at a periphery of the heater being formed such that a distance from the heater to the reflecting member becomes equal.

5. The color developing machine according to claim 1, wherein the color developer includes wall portions that face each other with the transportation path in between, and one wall portion is freely movable to move closer to or to move away from the other wall portion.

6. The color developing machine according to claim 5, wherein the one wall portion is freely movable along the horizontal direction.

7. The color developing machine according to claim 1, further comprising:

an exhauster, disposed at an upper side of the transportation path.

8. The color developing machine according to claim 1, further comprising:

a carry-in roller, arranged on an upper side of the transportation path.

9. A printing device, comprising:

a printing machine that is configured to attach an ink to a print medium; and the color developing machine according to claim 1, including the transportation path that extends in the direction intersecting the horizontal direction and in which the carry-in port and the carry-out port of the print medium are in communication with the outside air, and being provided to heat and color develop the print medium on which the ink is attached.

10. The printing device according to claim 9, wherein the color developing machine is coupled with a position in a height direction freely adjustable with respect to the printing machine.

11. The color developing machine according to claim 1, further comprising:

a shielding member, being configured to be in accordance with a size of the print medium.

* * * * *